US005967962A

United States Patent [19]

Huang et al.

[11] Patent Number: 5,967,962

[45] Date of Patent: Oct. 19, 1999

[54] APPARATUS AND METHOD FOR FORMING APERTURE CUTOUTS FOR A PACK OF SELF-OPENING PLASTIC BAGS

[76] Inventors: Frank F. J. Huang, 2345 Burnham Dr.; Daniel C. Huang, 12450 Hazeltine, both of Tustin, Calif. 92680

[21] Appl. No.: 08/921,808

[22] Filed: Sep. 2, 1997

[51] Int. Cl.[6] ..... B31B 1/14; B65D 19/00; B26D 7/06

[52] U.S. Cl. ..... 493/342; 493/199; 493/203; 493/204; 493/373; 83/100; 83/24

[58] Field of Search ..... 493/199, 200, 493/203, 204, 227, 228, 229, 237, 240, 241, 242, 340, 344, 353, 394, 363, 364, 372, 373, 378, 923, 930; 83/100, 24

[56] References Cited

U.S. PATENT DOCUMENTS

| | | | |
|---|---|---|---|
| 2,790,591 | 4/1957 | Rosen . | |
| 3,352,411 | 11/1967 | Schwartzkopf . | |
| 3,368,441 | 2/1968 | Piaze . | |
| 3,380,579 | 4/1968 | Pinto . | |
| 3,720,141 | 3/1973 | Stock . | |
| 3,739,694 | 6/1973 | David . | |
| 3,747,298 | 7/1973 | Lieberman . | |
| 3,802,308 | 4/1974 | David . | |
| 4,074,674 | 2/1978 | Kuklies . | |
| 4,480,750 | 11/1984 | Dancy . | |
| 4,526,639 | 7/1985 | Reimann . | |
| 4,595,389 | 6/1986 | Lehmacher . | |
| 4,699,608 | 10/1987 | Pistner . | |
| 4,767,391 | 8/1988 | Jensen | 493/101 |
| 4,785,938 | 11/1988 | Benoit . | |
| 4,877,473 | 10/1989 | Snowdon . | |
| 4,946,431 | 8/1990 | Jensen | 493/196 |
| 4,981,216 | 1/1991 | Wilfong . | |
| 4,995,860 | 2/1991 | Wilfong | 493/195 |
| 5,009,740 | 4/1991 | Yanai . | |
| 5,049,349 | 9/1991 | McCullough . | |
| 5,087,234 | 2/1992 | Prader . | |
| 5,183,158 | 2/1993 | Boyd . | |
| 5,188,235 | 2/1993 | Pierce . | |
| 5,226,858 | 7/1993 | Snowdon | 493/195 |
| 5,322,202 | 6/1994 | Pellitiet | 493/342 |
| 5,335,788 | 8/1994 | Beasley . | |
| 5,421,803 | 6/1995 | Kemanjian | 493/198 |
| 5,484,376 | 1/1996 | Prader | 493/194 |
| 5,507,713 | 4/1996 | Glod | 493/193 |
| 5,562,580 | 10/1996 | Beasley | 493/194 |
| 5,609,557 | 3/1997 | Te | 493/344 |

*Primary Examiner*—John Sipos
*Assistant Examiner*—Christopher W. Day
*Attorney, Agent, or Firm*—Daniel R. Kimbell

[57] ABSTRACT

An apparatus, method, and pack of tabless, self-opening bags with flapless aperture cutouts pack. In the apparatus and method, cylindrical dies connected to a vacuum source are used to cut out plugs of holes, and the plugs are evacuated to a receptacle. Compression bars, or a relatively shallow bevel cut on the cylindrical die, are used to form area of frangible bonding in the central tab portion of the bag pack. The pack of tabless, self-opening bags with flapless aperture cutouts has no flap portions which might inadvertently detach from bag pack.

14 Claims, 6 Drawing Sheets

FIG. 5
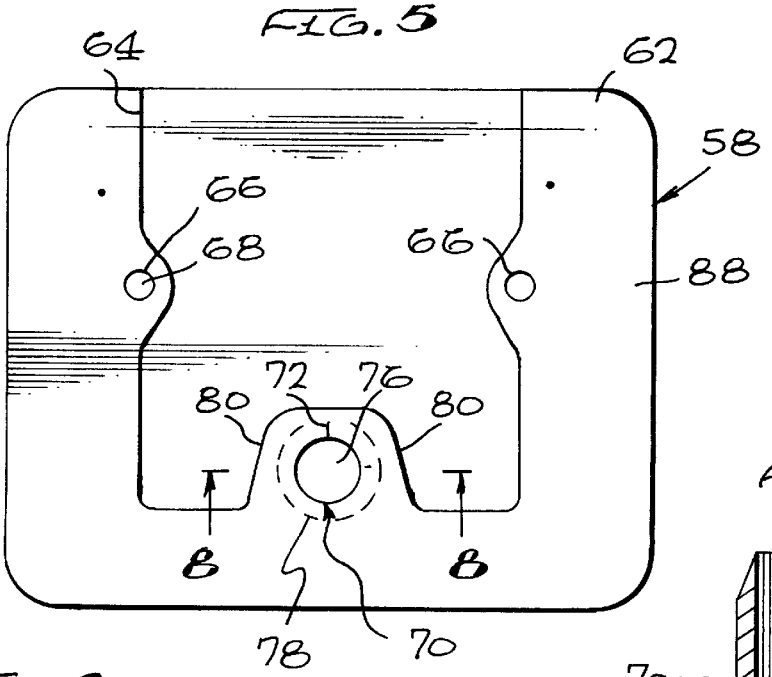
FIG. 7
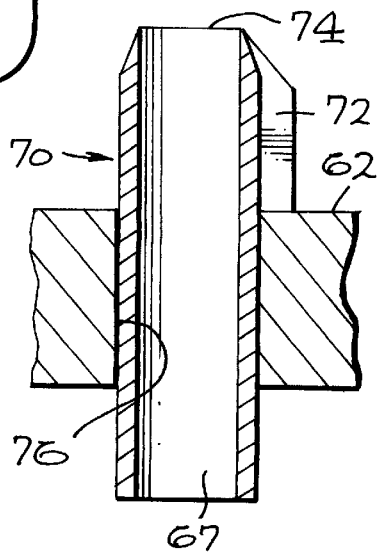
FIG. 6
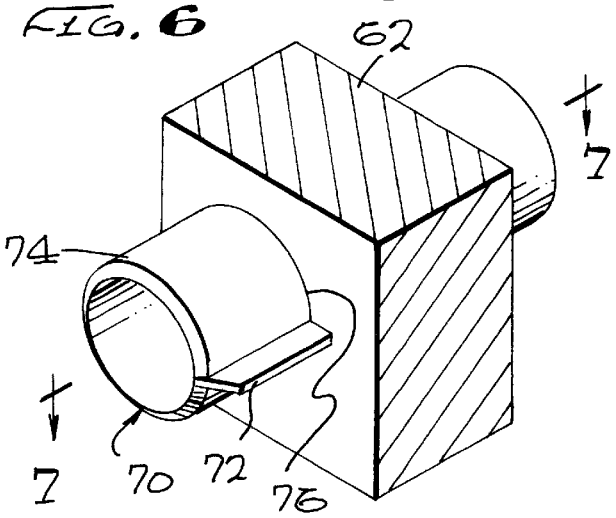
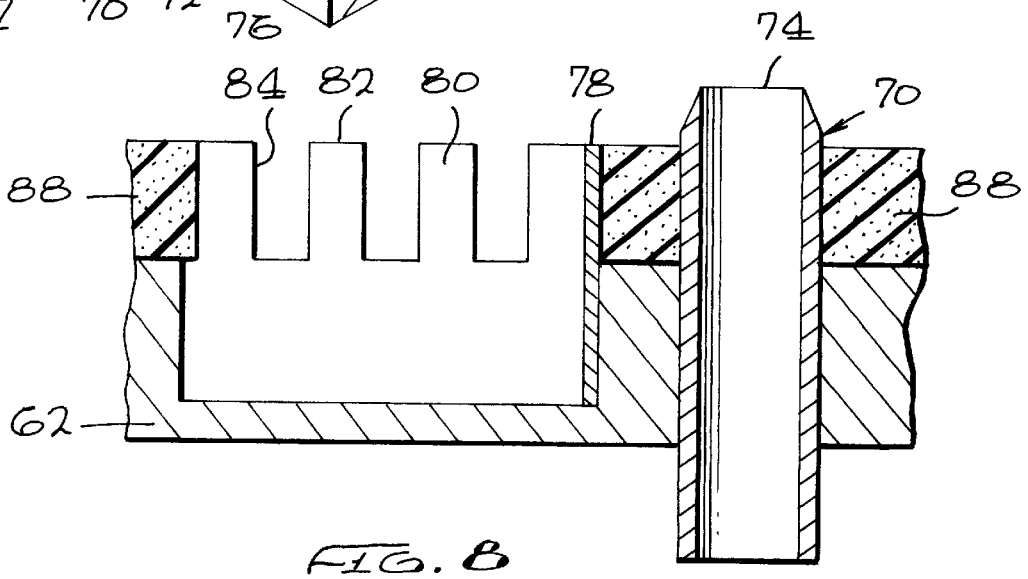
FIG. 8

FIG. 10
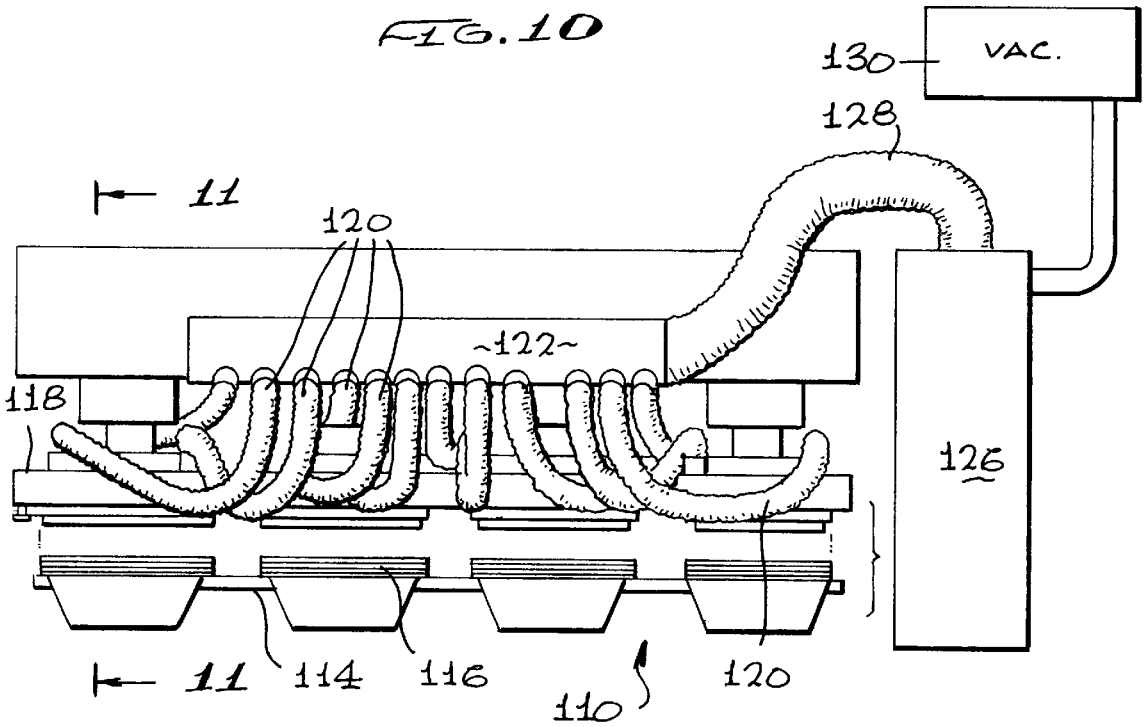
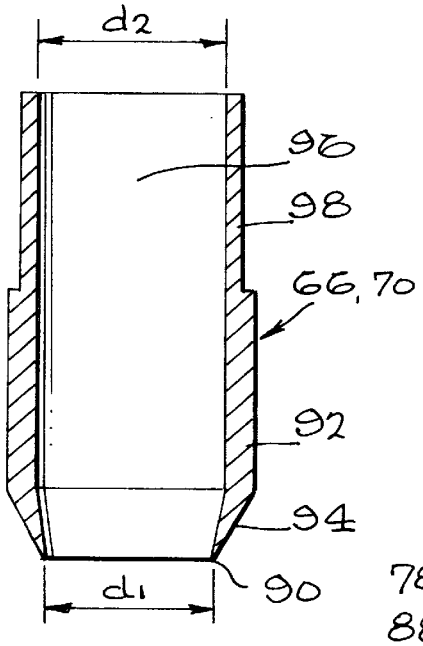
FIG. 9
FIG. 11
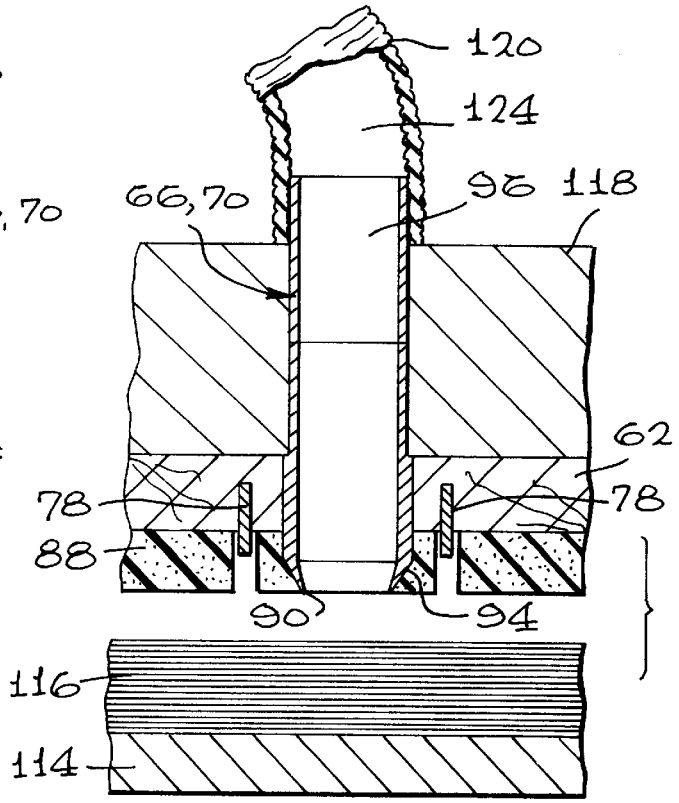

FIG. 12
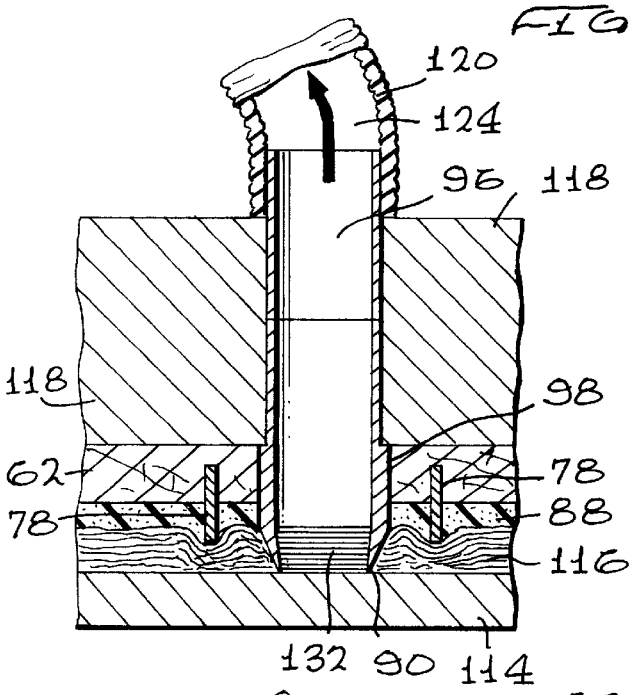
FIG. 14
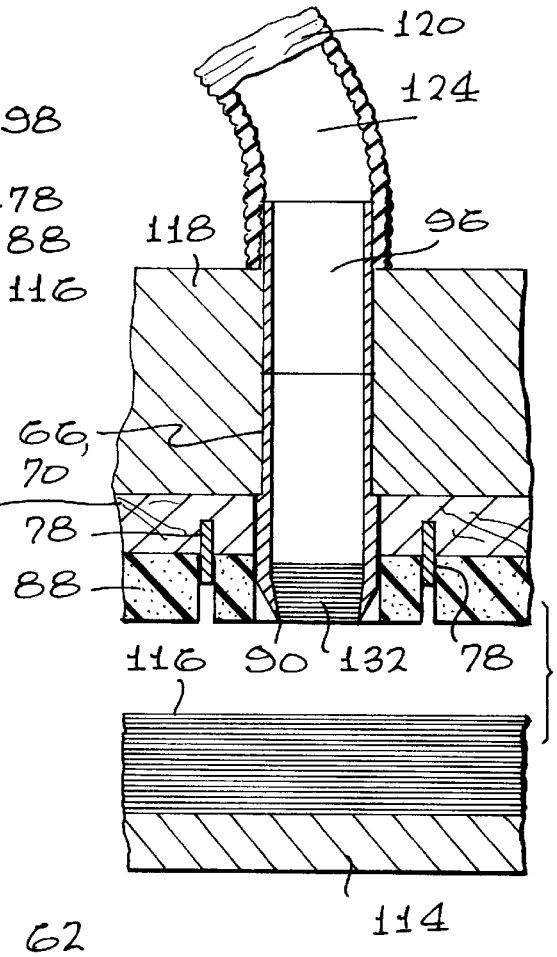
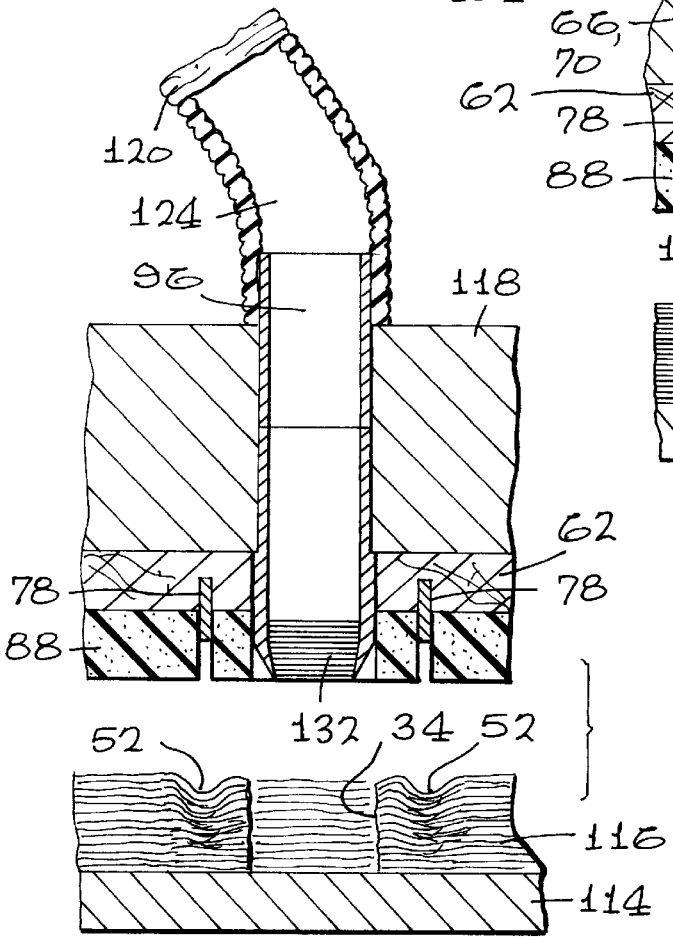
FIG. 13

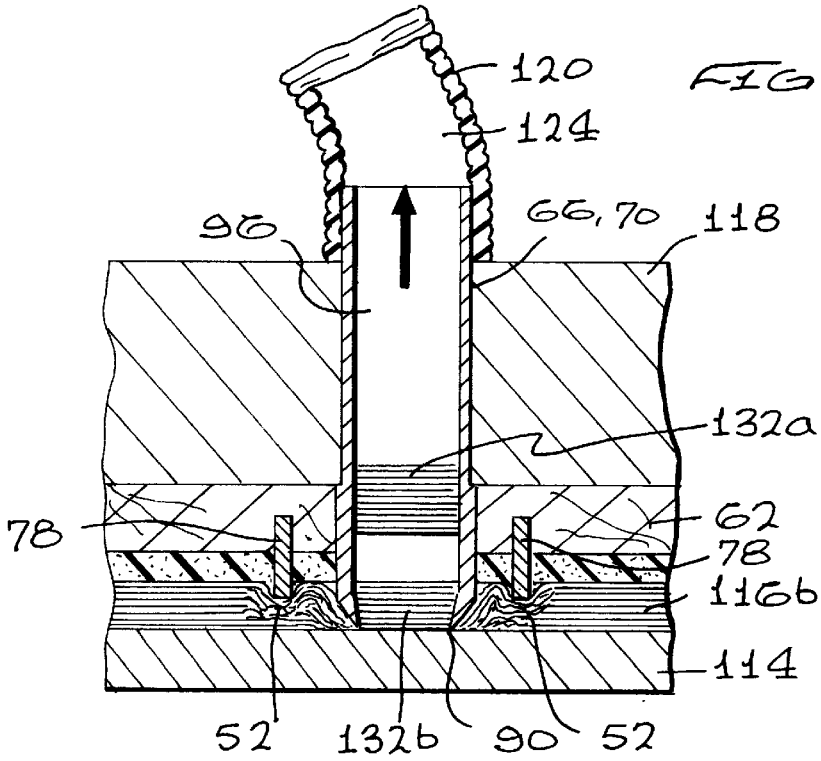
FIG. 15
FIG. 16
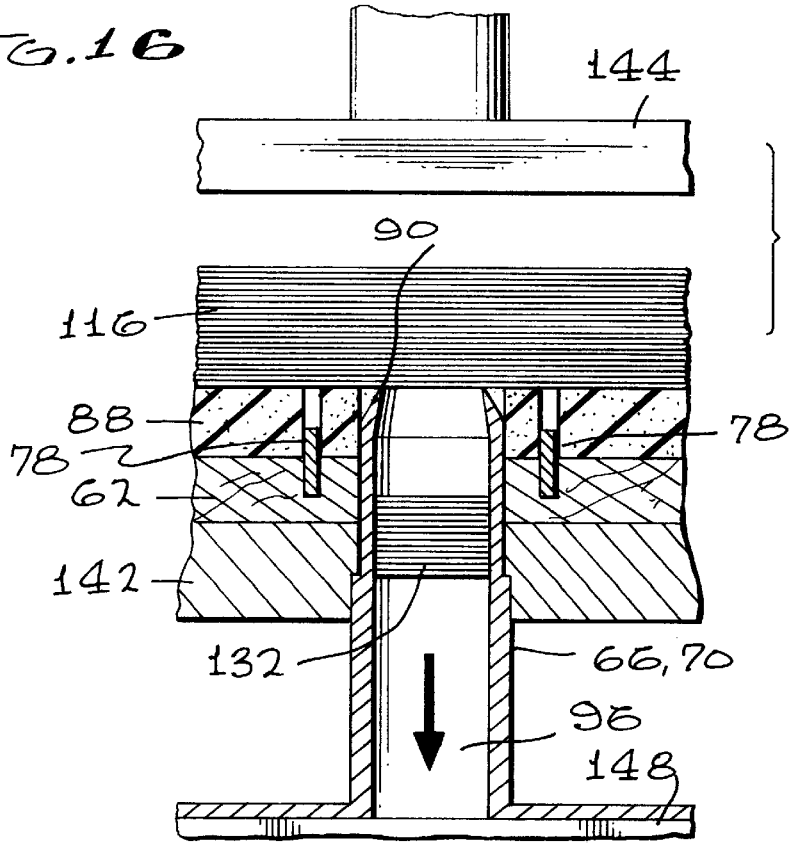

APPARATUS AND METHOD FOR FORMING APERTURE CUTOUTS FOR A PACK OF SELF-OPENING PLASTIC BAGS

BACKGROUND OF THE INVENTION

1. Field of the Invention

This invention relates to plastic bags, and more particularly to an apparatus and method for forming flapless aperture cutouts in a pack of plastic bags and the pack of bags made by the apparatus and method.

2. Description of the Prior Art

Many groceries stores and other merchants use a style of plastic bag to bag groceries and other merchandise commonly referred to as T-shirt bags. T-shirt bags are pleated bags which are closed, by heat sealing, at a bottom edge, and have a pair of integral loop handles extending upwardly from side edges to define an open mouth of the bag therebetween. T-shirt bags are normally provided in packs of aligned bags and these packs of bags are typically used with bagging racks.

T-shirt bags are manufactured by the following process. A continuous tube of high density polyethylene ("HDPE") plastic, or other plastic materials having the desired color, thickness, and diameter (such as low or linear low density polyethylene ("LDPE" or "LLDPE") or any of the polyolefins) is formed on a extruding machine. The continuous plastic tube is then passed over rollers to roll the continuous plastic tube onto a spool. If the bags to be formed from the continuous tube of HDPE are to be printed on one or both sides, the newly formed continuous plastic tube will be subjected to corona surface treatment, wherein the side or sides of the continuous flattened tube of plastic to be later printed will be passed by high voltage corona discharge electrodes. Corona surface treatment affects electrical and chemical changes on the plastic's outer surface to prepare that surface of the bag for printing. Regardless of whether the bags will be printed on one or both sides, it is a common practice in the plastic bag manufacturing industry to corona surface treat the entire outer surface of the rolls of continuous plastic tubing so that printing can be done on either one or both either sides, as later may be required. Corona surface treatment also helps contribute to frangible bonding between adjacent surfaces of corona treated plastic sheet material when these surfaces are compressed together.

After being corona surface treated (if the bags might be printed), the roll of continuous plastic tube is pleated on a pleated machine. Following this, a bagging machine heat seams and cuts sections of the pleated tube at top and bottom edges to form closed and flattened pleated bags of a desired length and width, with the pleated sides being at both sides of the flattened pleated bags. These sections are often referred to as "pillowcases." Further downstream of the heat seaming and cutting step, the pillowcases are stacked in aligned stacks. Thereafter, hydraulic die cutting or other cutting methods are utilized to cut, compresses, serrate, and remove material at the stacked pillowcases' top portions to form the various cuts, areas of compression, serration, and the like, to form these features in the finished bags of the bag pack. For example, cutting removes material to form the shape of the handles and the outline of the mouth and mouth tab, and forms desired apertures through the handles and mouth tab. Blunt blades, cold or heat posts and pins, and other means can be used to frangibly or permanently hold together portions of the bag. These can be combined with cutting means to compress the bag material together, and to form apertures in the bag pack. The apertures in the handles and the apertures in the mouth tab are provided for use in supporting the pack of self-opening bags on hooks positioned on a bagging rack. Each loop handle will comprise four layers of plastic material since they are cut out from the pleated side portions of the bag. It is this portion of the method that is the focus of Applicants' invention.

The apertures in handles and central mouth tab can be relatively straight, curved, horseshoe shaped, hooked, J-shaped, or have other shapes. When a cut line consist of a shape other than a substantially straight line, and no two points of a cut line intersect, a flap is formed. These flaps can be variously used to allow a portion of a bag pack, for example such as a handle or mouth tab, to be mounted on a suspension arm or hook of a bagging rack. The stack of flaps will be pushed away to accept the suspension arm or hook, and can provide additional friction to retain a portion of the bag pack in place without sliding around. There are problems associated with having flaps, however. When a single bag is removed from the stack of bags on a bagging rack these flaps can flop around and appear unsightly. Another problem is that if these flaps are pulled or get caught on something, the cut line defining the flap can migrate from the terminal ends of the cut line, causing unintended tearing of the bag, and also possible separation of the flap from the bag. Straight or relatively straight cuts do not have the problem of flaps becoming separated, but straight cuts tend to propagate and can cause unintentional tearing. For this reason, sometimes tear guards are provided at or adjacent the terminal end of cut lines, which can consist of curved cut line. The alternative to providing either a slit bag design problem or forming openings in a stack of bags during the manufacturing relatively straight cut line or flaps, is to eliminate flaps entirely by forming cutout. These cutouts can be circular or have some other shape. However, forming cutouts though stacks of thin film material has been difficult from a manufacturing standpoint since these small cutout tend to become scattered and fly around the manufacturing facility and are difficult to collect.

Turning again to bag styles, there are at two major styles of central tab arrangements. In a one style, which will be termed a "tabbed" style, the central suspension tab provided above the mouth region of the bag between the arms has an aperture formed therethrough. This aperture is used to support the center of the bag pack on a hook of a bagging rack. A slit, tearing line, or perforation, or some combination of these, is located below the suspension tab. In front-side free bag styles, the slit extends entirely across the front wall of the bag, but some material remains on the rear wall of material to hold the tab to the bag and therefore support the bag pack. In the more typical tabbed style, the front side of the bag is not cut all the way through. In tabbed bag packs, the stack of suspension tabs are generally fixed together, such as with a heat weld, to form a "book". When a single bag is pulled forward from the bagging rack to remove it from the stack of bags retained there, the portion of the bag below the slit or tearing line will tear through, separated the bag mouth from the book, but leaving the book on the bagging rack. As bags are used, the remaining books must be periodically removed and discarded, which is inconvenient.

In a second major style of central mouth tabs, termed a "tabless" style, no book portion remains on the bagging rack after use. In this style, the suspension aperture is also designed to tear through, to thereby free the mouth portion of a bag from the stack of bags on the rack. Typically, with the tabless style of bag, a portion of the bag remains attached to the mouth portion of the bag, be it a flap portion or some other extension portion. This flap or extension portion can pose a tear through problem, can become separated from the bag pack, and can sometimes look unsightly. There is accordingly an advantage in providing a cutout or cutouts through the central tab, and/or through the handles, for that matter, which leave no flaps, in lieu of utilized flapped apertures.

In order to prepare a T-shirt bag for loading with merchandise, only the first layer of the bag material of the top bag, and no other layers must be pulled forward, thereby opening just the top bag. Since the HDPE and other typical bag materials are very thin, typically between 1 to 0.5 mil thick (0.001 and 0.0005 inches), it is sometimes difficult for the checkout clerk or box person to grasp just the top layer of bag material. One can often see a sponge, or source of tacky material, such as a glue stick, retained at the top of bagging racks, with which the checkout clerk or box person can dampen his or her fingers to aid in grasping just the top layer of material of the bag. However, this takes additional time and effort in the bagging process. This cycle will have to be repeated with each successive bag to be loaded.

Several approaches have been taken to overcome the lack of a self-opening feature problem. U.S. Pat. No. RE 33,264 to Baxley et al. discloses a pack of T-shirt bags wherein spots of adhesive are placed between the rear wall of the forwardly lying bags and the front wall of the rearwardly lying bags. The use of these spots of adhesive is intended to provide for self-opening of the bags as each successive bag is pulled off the pack of bags on the bagging rack. However, the use of spots of adhesive is undesirable from a cost and reliability standpoint because an extra manufacturing step of depositing spots of adhesive on the growing stack of pillowcases as each subsequent pillowcases is stacked thereon is required. Handle flaps are formed in the bag handles which are heat sealed together in the pack of bags. These handle flaps will preferably sever from the pack of bags when the bag pack is loaded on the rack, leaving holes. In the event the flaps do not sever from the handles upon loading the pack on the rack, severing of the removed bags handle flaps will take place as each bag is removed from the bag pack on the rack.

U.S. Pat. No. 5,074,674 to Kuklies et al. discloses a packs of bags similar to that of Baxley, et al. wherein the front wall of each bag is either relieved or removed in the region of the central tab so as not to be retained by the tab receiving hook on the bagging rack, purportedly allowing the front wall of the bag to be grasped more easily to open the bag. However, this style also requires an extra, and difficult manufacturing step of removing or relieving a portion of only the front wall of each bag. The pack of bags of Kuklies et al. does not provide for self-opening of the bags.

U.S. Pat. No. 4,877,473 to Snowden et al. discloses a pack of bags wherein the tearing line has a central arched portion which forms a sub tab. This sub tab can be easily grasped and pulled forward to pull the front wall of each bag to open that particular bag. However, each subsequent bag in the pack of bags must be opened in the same manner, and thus the desired self-opening feature is absent.

U.S. Pat. No. 5,087,234 to Prader et al. discloses a method of forming a pack of easy-open T-shirt bags, wherein the bags have been corona discharge treated in the handle and bag mouth regions and such that the pressure and cutting action applied during the formation of the pack of bags will cause adjacent facing cut edges to releasably act here together until a moderate force separates them. During the step of removing a topmost bag from a pack of bags on the rack, at least a portion of the cut edge of the mouth and handle region of the front wall of the next bag will follow the bag being removed for a short distance before separating. This opens the next bag, readying it ready for loading. Prader et al. states that the pressure necessary to effect the adhesion of the treated surface is supplied during the cutting step and that any pressure involved in the formation of the handles in the bag mouth and is satisfactory for adhesion. Accordingly, by Prader et al, one would expect light frangible bonding to be formed all along the cut edges of the bag packs handle, handle apertures and central mouth tab. In contrast, Applicant has found that the frangible bonding inherently formed when corona discharge treated plastic bag packs are cut does not result in a reliable self-opening feature.

U.S. Pat. No. 5,183,158 to Boyd et al. discloses a bag pack which includes a self-opening feature, arising out plural, i.e. upper and lower, releasable means between adjacent bags. The releasable means arises out of forming compression areas through the bag stack. Boyd et al. discloses three types of suitable releasable means as including the use of low-tack pressure sensitive adhesive, the use of corona discharge treatment in combination with the application of pressure, and the application of considerable pressure through layers of adjacent bags. In Boyd, the preferred embodiment is to utilize considerable pressure through the layers of the bag pack in order to achieve a reasonable adhesion between the rear portion and front portion of each bag.

U.S. Pat. No. 5,188,235 to Pierce, et al. discloses a bag pack system with a central mounting tab on the mouth of the multiple stacked bags with a vertical perforation extending between a generally horizontal central mounting aperture and the bag mouth, to permit a bag to be removed without leaving the "book" portion of the central mounting tab on the bagging rack. In the Pierce, et al. bag pack cold pin holes are made through the handles above the handle apertures and through the central mounting tab on either side of the vertical perforation. The cold pin holes near the vertical perforation are said to provide a self-opening feature for the bags. However, in Applicant's experience, cold pin holes do not provide adequate frangible bonding necessary for a reliable self-opening feature.

Both U.S. Pat. Nos. 5,335,788 and 5,562,580 to Beasley et al. disclose self-opening polyethylene bag stacks, (composed of at least 50% by weight of high density polyethylene) and process for forming the packs, which rely on the stack of bags being formed of corona treated polyethylene film which has been compressed under high pressure in localized, upper regions under the bag mouth, and preferably spaced below the cut lines forming the bag mouth, to thus form an area of frangible bonding which is available to create the self-opening feature. The Beasley et al bags are tabbed bags, and leave a book of tabs on the bagging rack as each bag is sequentially removed from the bagging rack. U.S. Pat. No. 5,562,580 to Beasley et al. was filed as a divisional of U.S. Pat. Nos. 5,335,788 to Beasley et al., with the subject matter of U.S. Pat. Nos. 5,335,788 being directed to self-opening bag pack and with the subject matter of U.S. Pat. No. 5,562,580 being directed to a process for manufacturing a self-opening bag pack. The Beasley et al. patents stress that the conditions of heat and pressure that readily cause blocking in corona treated low density polyethylene (LDPE) and linear low density polyethylene (LLDPE) are insufficient for high density polyethylene (HDPE). The Beasley et al. patents further state that even when the cutting blades are dulled in order to increase the degree of pressure exerted on the bags during the cutting process, self-adhesion of adjacent bags for self-opening is not achieved with HDPE. In the divisional patent, the patent states, in its claim 1, that "said mouth openings defining an upper end of said bag stack". The inventors herein believe that given the narrow language of the specification, and the clear nature of the drawings, this language cannot be interpreted to broaden the meaning of "mouth" to encompass the central tab.

There are numerous bag designs which incorporate holes at top regions of the bag packs to suspend the bag on a rack. U.S. Pat. No. 2,790,591 to Rosen discloses a handleless bag having a single hole located at its top edge for suspension on a single arm of a rack, for filing with commodities.

U.S. Pat. No. 3,352,411 to Schwarzkopt discloses a bag pack with tear off portion(s) at its upper, which tear off portions can have hole, or holes formed therethrough. The tear off portions remain on the rack as each individual bag is removed from the rack.

U.S. Pat. No. 3,380,579 to Pinto discloses a handleless bag pack with a pair of holes formed in a top edge, with the pack riveted together.

U.S. Pat. No. 3,747,298 to Lieberman and U.S. Pat. No. 4,106,733 to Walitalo disclose bag dispensing units for use with handleless bags with holes adjacent a top edge of the bag packs. The holes are for use in suspending the bags on the bagging racks' arms.

U.S. Pat. No. 4,480,750 to Darcy discloses a style of handles bags wherein detachable mounting tabs are located on inside edges of the bag handles in the packs. Mounting apertures are formed in the mounting tabs, and are said to be preferably formed by a heated pin to weld the tabs together, so that as each bag is removed from the bag pack, they can be torn free from the stack of heat welded together mounting tabs which remain on the rack. The Darcy rack does not disclose a self-opening feature.

Lastly, U.S. Pat. No. 4,785,938 to Benoit, Jr. et al., discloses a bag pack with handles, where holes are formed in each handle for suspension of the handles on a rack. The Benoit, Jr. et al. bag packs employ a front-side-free bag design where the front tab is either completely from the front wall of the bag, or comparatively weakly connected thereto, while the rear tab is connected to the rear wall through a localized line of film weakening which is comparatively stronger than the front tab-front wall connection. The disclosed method of manufacturing the bag require forming individual bags first, processing the individual bags to form the front-side-free feature, and then stacking the bags and heat sealing them together.

Despite the attempts to overcome the problems associated with these presently available bags, there remains a need for an apparatus and method to manufacture, and the improved pack of T-shirt bag pack formed thereby, which (1) can be easily loaded on a bagging rack, (2) does not leave a book of plastic tabs on the bagging rack, (3) does not have flap formed in its suspension apertures, and (4) includes a reliable self-opening feature.

SUMMARY OF THE INVENTION

The present invention overcomes the above noted deficiencies of the presently available bags by providing a novel apparatus and method for manufacturing a pack of bag packs with flapless aperture cutouts formed therethrough and the pack of bags made thereby and optionally an apparatus and method for providing for a self-opening feature on the bag pack that permits successive bags of the pack of bags to be easily self-opened from the pack of bags.

The invention provides an apparatus for forming a pack of self opening plastic bags from a stack of bag pillowcases, the pack of self opening plastic bags having a central tab portion extending from a mouth, a pair of handles, and a flapless aperture cutout formed in at least the central tab portion, the apparatus comprising:

a die unit, comprising at least one die for forming a flapless aperture cutout in the central tab portion, the at least one die having a continuous perimeter wall which defines an interior passageway therein, the perimeter wall having a forwardly lying sharpened cutting edge, and a compression means for forming frangibly bonded areas in the central tab portion;

means for moving the die unit;

a vacuum generating source;

a receptacle connected to the vacuum generating source;

vacuum lines connecting the passageways of the at least one die with the receptacle;

wherein application of the die unit by the means for moving the die unit to a stack of bag pillowcases will cause plugs to be cut from the bag pack, and will cause localized areas of frangible bonding to be formed through the stack of bag pillowcases, wherein the plugs will be evacuated through the vacuum lines to the receptacle.

The invention also provides an apparatus for forming a pack of self opening plastic bags from a stack of bag pillowcases, the pack of self opening plastic bags having a central tab portion extending from a mouth, a pair of handles, and a flapless aperture cutout formed in at least the central tab portion, the apparatus comprising:

a die unit, comprising at least one die for forming a flapless aperture cutout in the central tab portion, the at least one die having a continuous perimeter wall with a sharp cutting edge which defines an interior passageway therein, the perimeter wall having a forwardly lying sharpened cutting edge, and a compression means for forming frangibly bonded areas in the central tab portion;

means for moving the die unit;

a receptacle in communication with the interior passageway of the at least one die;

wherein application of the die unit to a stack of bag pillowcases will cause cutout plugs to be cut from the bag pack, and will cause localized areas of frangible bonding to be formed through the stack of bag pillowcases, wherein the cutout plugs will be pushed downwardly through the interior passageway of the at least one die and into the receptacle.

The invention further provides a method for forming, from bag pillowcases made of plastic material, a pack of self-opening plastic bags having a central tab portion extending from a mouth, a pair of handles, and flapless aperture cutout formed in the central tab portion and in the handles, the method comprising the steps of:

stacking in alignment a plurality of flattened plastic bag pillowcases sealed at top and bottom edges thereof;

providing a die mnit comprising a backing plate, a sharp blade portion affixed to the backing plate and shaped for forming an outline of handles, a mouth, and a central mouth tab portion of a bag pack, two generally cylindrical flapless handle cutout die portions having sharp cutting edges and defining an interior passageway and positioned in holes in the backing plate, and a generally cylindrical flapless central mouth tab cutout die portion with a sharp cutting edge and defining an interior passageway and positioned in a hole in the backing plate, the generally cylindrical flapless central mouth tab cutout die portion having a tear initiating blade portion extending therefrom, and wherein the compression means comprises a bar portion positioned on the backing plate and having a forward edge which extends forward from the backing plate a lesser degree than does the cutting edges of the sharp blade portion and the generally cylindrical flapless central mouth tab cutout die portion;

providing means to move the die unit; and applying the die unit to the stack of plastic bag pillowcases such that the sharp blade portion cuts the outline of the bag packs handles, mouth and central mouth tab, the two generally cylindrical flapless handle cutout die portions form the flapless handle cutouts which are forced into the passages thereof, the generally cylindrical flapless central mouth tab cutout die portion and the tear initiating blade portion forms the generally cylindrical flapless central mouth tab cutout and tearing slit and the cylindrical flapless central mouth tab cutouts are forced into the passages thereof, and the bar portion forms the areas of frangible bonding between adjacent bags.

The invention also provides a pack of self-opening bags, comprising:

a bag pack having a plurality of bags stacked in alignment, each of the bags having opposed front and rear walls with outer surfaces, the opposed front and rear walls being closed at a bottom edge, a pair of upwardly extending handles with a mouth region located therebetween, central mouth tabs extending upwardly from the mouth region of the front and rear wall, the central mouth tab having a flapless mouth aperture cutout formed therethrough with a tearing slit in communication with a top of the flapless mouth aperture and extending upwardly, each bag handles having a flapless bag handle cutout formed therethrough, wherein the walls of the plurality of individual bags of said pack of bags are held together by frangible bond means formed through the central mouth tab, and wherein the frangible bond means create a self-opening feature.

BRIEF DESCRIPTION OF THE DRAWINGS

FIG. 5 is a plan view showing the die unit utilized to form the outline of the bag, including its handles, mouth tab, apertures and frangibly bonded areas, corresponding to the embodiment of FIG. 4.

FIG. 6 is a partial perspective view of a die used to form mouth cutout holes in the central mouth tabs bag packs of FIGS. 1 and 2.

FIG. 7 is a partial cross-sectional view of the die through view lines 7—7 of FIG. 6.

FIG. 8 is a cross-sectional view of the die through view lines 8—8 of FIG. 5.

FIG. 9 is a cross-sectional view of a preferred embodiment of the die used to form cutout holes through the bag pack.

FIG. 10 is a front perspective view of a hydraulic press used to form the bag packs with flapless, circular cutout holes.

FIG. 11 is a cross-sectional view through view lines 10—10 of FIG. 9, showing the hydraulic press and die unit positioned above a stack of uncut bags.

FIG. 12 is a cross-sectional view of the hydraulic press with the die brought into contact with a stack of bags to form the central mouth holes therethrough, with the plug of holes forced upwardly in the die's passageway and with frangible bonds being formed.

FIG. 13 is a cross-sectional view of the hydraulic press after the die has been brought into contact with a stack of bags, thereby forming the central mouth hole in the bag pack and frangible bond, with the plug of central mouth holes forced upwardly in the die's passageway.

FIG. 14 is a cross-sectional view of the hydraulic press showing a second stack of uncut bags ready for cutting of central mouth holes therethrough, with the plug of handle holes from the first pack of bags retained in the die's passageway.

FIG. 15 is a cross-sectional view of the hydraulic press with the die brought into contact with a second stack of bags to form the central mouth hole therethrough, with the two plugs of central mouth holes traveling up the center of the die's passageway.

FIG. 16 is an alternate arrangement of the hydraulic die used to form the bag packs, wherein the die is positioned on a stationary, lower part of the hydraulic press.

DESCRIPTION OF THE PREFERRED EMBODIMENT

Figure 1:
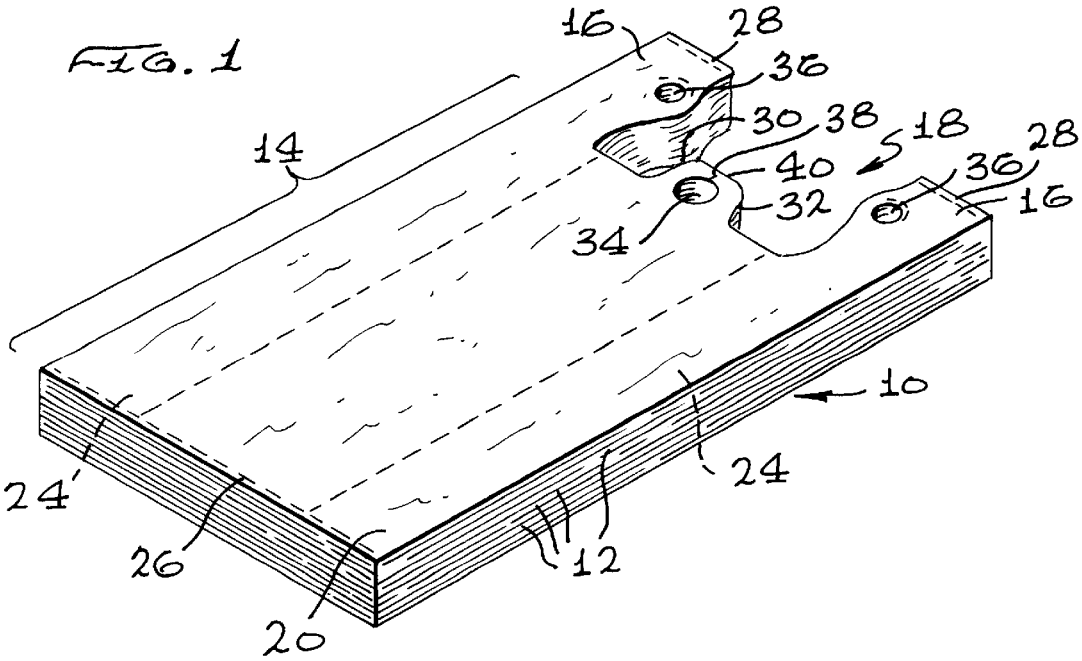
FIG. 1 is a perspective view of a pack of self-opening bags of the invention.
Figure 2:
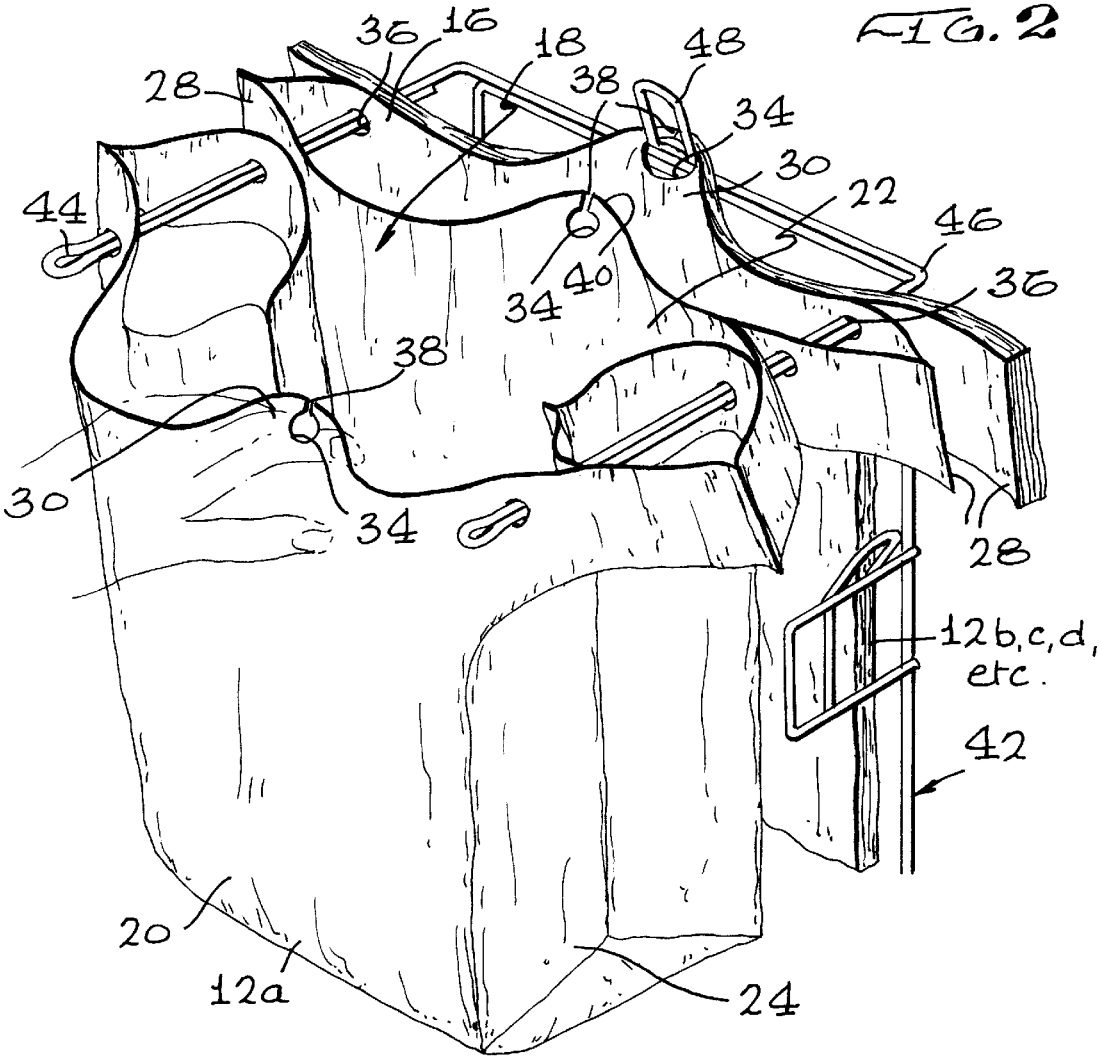
FIG. 2 is a perspective view of a first embodiment of the pack of self-opening bags of the invention on a bagging rack, shown with the topmost bag of the pack of bags torn free from the tab hook of the bag rack and opened up for loading with merchandise.

Referring to drawing FIGS. 1 and 2, reference numeral 10 designates the self-opening bag pack formed in accordance with the invention. Each individual bag 12 of the bag pack 10 has a lower body portion 14 with two loop handles 16 extending upwardly from the lower body portion 14, at opposite sides of the bags 12, with a mouth 18 thereby defined therebetween. Individual bags 12 each have a front wall 20, and a rear wall 22, joined together by pleated side walls 24. T-shirt bags 12 are sealed together at their bottom edges 26 to form lower body portion 14 and at their top edges 28 to form loop handles 16. Heat seaming is the preferred method of sealing bottom and top edges 26 and 28 of bags 12, but other means can be employed, if desired. A central mouth tab portion 30 extends upwardly from top edges 32 of front and rear walls 20 and 22 at mouth 18 of bags 12 between two loop handles 16. Central mouth tab portion 30 has a mouth cutout hole 34 passing through pack of self-opening bags IO. Suspension apertures, preferably in the form of flapless handle cutouts 36, are formed through handles 16. A tearing slit 38 is formed in central mouth tab portion 30 and extends from the uppermost region of mouth cutout hole 34 upwardly. Prior to a bag 12 being pulled away from bag pack 10, tearing slit 38 does not intersect the apex 40 of central mouth tab portion 30 (which is best shown in FIGS. 3 and 4.)

As shown in FIG. 2, a pack of bags 10 is retained on bagging rack 42 as follows. Handles 16 are carried on arms 44 of bagging rack 42 by passing flapless handle cutouts 36 in handles 16 onto arms 44. Arms 44 are spaced apart and extend forwardly from back wall 46. Bagging rack 42 has a hook 48 on its back wall 46. Mouth cutout hole 34 in central mouth tab portion 30 is placed over hook 48 to suspend the middle portion of bag pack 10 on bagging rack 42.

Figure 3:
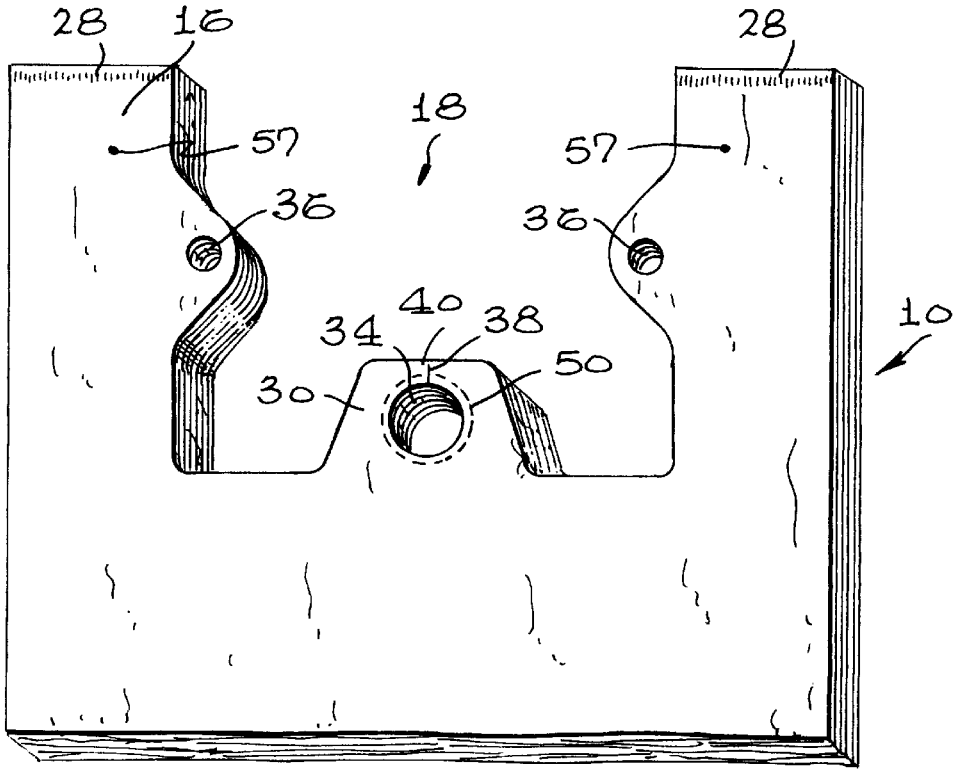
FIG. 3 is a fragmentary perspective view of the upper area of a first embodiment of the bag pack of FIG. 1.
Figure 4:
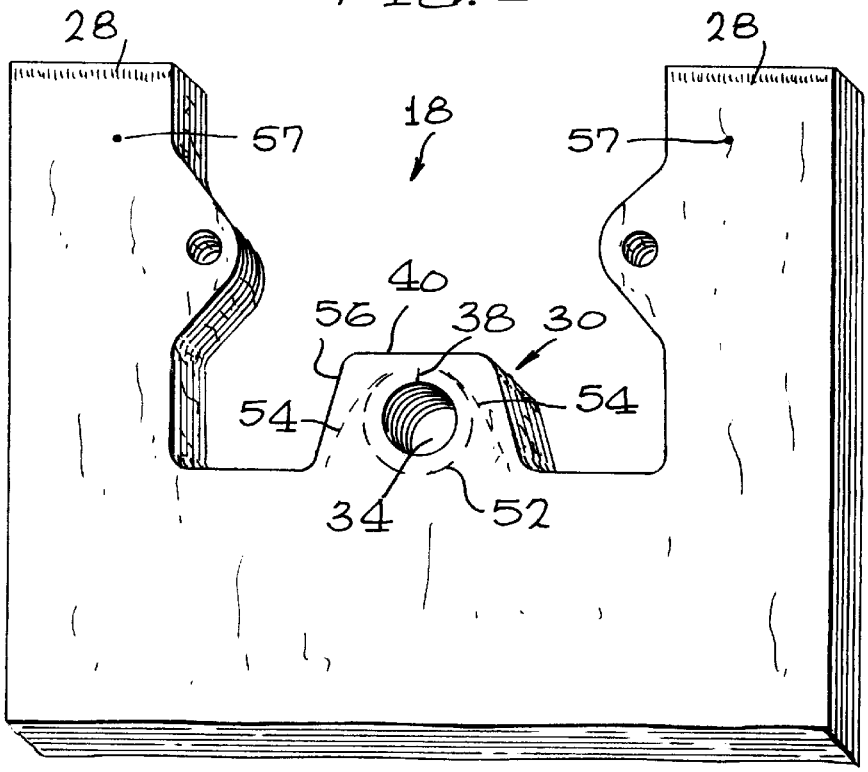
FIG. 4 is a fragmentary perspective view of the upper area of a second embodiment of the bag pack of FIG. 1.

Referring to FIGS. 3 and 4, two different embodiments of bag packs 10 and 60 are shown in fragmentary perspective views of the upper area of a bag packs 10 and 60. In the embodiment of FIG. 3, an area of frangible bonding 50 is formed adjacent to mouth cutout hole 34 and extends substantially all the way around mouth cutout hole 34 except does not intersect tearing slit 38. In the embodiment of FIG. 4, an area of frangible bonding 52 is formed around, but substantially spaced apart from, mouth cutout hole 34 portion. Frangible bond areas 54 are also formed adjacent to and below portions of top edge 56 of mouth tab 30. A cold pin hole 57 is formed through each of handles 16 and functions to retain handles 16 in stacked alignment.

In both embodiments of FIGS. 3 and 4, frangible bonding areas 50, or 52 and 54 act to frangibly bond the exterior surfaces of front 20 and rear walls 22 of adjacent bags 12 together, and is an important feature in enabling a self-opening feature of bag pack 10. As previously noted, corona film treatment aids in this frangible bonding.

Referring again to FIG. 2, as a front bag 12*a* is pulled away from bag pack 10 on bagging rack 42, the pulling will pull mouth cutout hole 34 against hook 48, and thereby placing pressure on tearing slit 38, which causes it to tear all the way through to apex 40 of central tab portion 30. The pulling force required to cause tearing slit 38 to tear all the way through to apex 40 of central tab portion 30 will not, however, immediately disrupt areas of frangible bonding 52 and 54 formed between rear wall 22 of front bag 12*a* and front wall 22 of following bag 12*b*. Thus, front wall 20 of following bag 12*b* is pulled forward and at least partially opens following bag 12*b* for easy loading by a store clerk or boxperson. The operation with bag of FIG. 3 will operate substantially the same, even though the design and placement of its areas of frangible bonding 50 is somewhat different.

Die unit 58 used to manufacture bag pack 60 of FIG. 4 is shown in FIGS. 5–8. Referring first to FIG. 5, die unit 58 includes a backing plate 62, which can comprise a piece of plywood, metal, plastic, or other strong material. A sharp cutting blade 64 bent to define a shape used to form handles, mouth region and central mouth tab is imbedded and retained in backing plate 62. A generally cylindrical handle hole die 66 has a continuous blade and has an opening formed therein and is retained on backing plate 62. Handle hole dies 66 are fit into holes 68 in backing plate 62. Mouth cutout hole die 70 is used to form mouth cutout portion 34. Like handle hole dies 66, mouth cutout hole die 70 comprises a continuous blade, such as in the general shape of a cylinder, but additionally has a tear initiating nicking blade portion 72 attached thereto. Dies 66 and 70 can have other shapes such as oval, polygons, etc., if desired. Tear initiating nicking blade portion 72 is used to form tearing slit 38. Edge 74 thereof is beveled and sharp. Mouth cutout hole die 70 fits into and is retained in a hole 76 in backing plate 62. A blunt, serrated compression bar 78 is used to form frangible bonding area 52 and is imbedded in backing plate 62. Other blunt, serrated compression bars 80 are used to form frangible bonding areas 54 and are also imbedded in backing plate 62. Referring to FIG. 8, serrated compression bars 78 and 80 have forwardmost portions 82 separated by relief portions 84. Serrated compression bars 78 and 80 extend forwardly from backing plate 62 less than does mouth cutout hole die 70, and thus, rather than cut through stack of bag pillowcase, the frontward portion only compresses layers of stacked pillowcases, and thereby forms frangible bonding area 52 and 54. Sharp pins 86 project from backing plate 62 and are used to form cold pin holes 57 through handles 16. Shown in FIGS. 5, 8, and 11–16, (but is not shown in FIGS. 6 and 7 for sake of simplicity) is a resilient layer 88 of foam, springy rubber, or other material which overlays backing plate 62. Resilient layer 88 does not cover holes 68 and 76 in dies 66 and 70, and is not in front of compression bars 78 and 80 or tear initiating blade portion 70.

The embodiment of bagging pack 60 of FIG. 4 is formed using a die which is similar to that of FIG. 5, except serrated compression bars 80 are excluded, and serrated compression bar 78 can be replaced with an unserrated compression blunt bar (not shown, but as that shown in FIG. 8 without reliefs 84), if desired. The thickness of compression bars 78 and 80, their degree of serration or unserration, and the distant they project from backing plate 62, the distance they are placed away from dies 70 and the portions of die 64 which will define central tab portion 30 of bag packs 10 and 60 can be varied to produce the desired degree of compression and frangible bonding.

Referring to FIG. 9, dies 66 and 70 can have a modified structure. In this structure, dies 66 and 70 have a sharp cutting edge 90 on the perimeter blade wall 92 which is exteriorly beveled, forming a beveled surface 94. (Of course, for use in forming mouth cutout hole 34, a tear initiating blade portion would be added, but is not shown.) If the beveled surface 94 is utilized to form areas of frangible bonding, it is preferable that the degree of bevel is less than 45 degrees from the vertical, and be more preferably less than about 40 degrees from the vertical, and even more preferably has a bevel angle between about 30 to 38 degrees from the vertical. If the area of frangible bonding is formed by a separate compression portion (not shown, but such as a serrated or unserrated bar, as in FIG. 8) the degree of bevel is less important.

Dies 66 and/or 70 have an inner diameter $d_1$, at its sharp cutting edge 90. The interior diameter of die 66 and/or 70 rearwardly of its tip 90 is $d_2$, which diameter $d_2$ is larger than the interior diameter $d_1$. Inner passageway 96 thus formed through the die 66 and/or 70 is smaller at die's cutting edge 90 than at points rearwardly thereof. Die 66 and/or 70 is preferably formed from machine tool steel, and has a collar 98. As shown in FIGS. 11–15, collar 98 can be fitted or simply passed through hydraulic press plate 118. The advantage of this style of die is explained further below with reference to the discussion of the apparatus and method. FIGS. 11–16 are discussed with respect to this embodiment of dies 66 and 70.

Turning to FIGS. 10–15, a front view of the apparatus 110 used to form bag packs of the invention is shown. Apparatus 110 comprises a hydraulic press 112. It has a stationary base portion 114 upon which rest stacks of bag pillowcases 116 prior to being cut. Movable hydraulic press plates 118 carry a number of die units 58 used to form the finished bag packs 10 or 60 of FIGS. 1–4 from a stack of uncut bag pillowcases 116. A number of vacuum hoses 120 connect the rearward ends of dies 66 and 70 to a vacuum manifold 122. The vacuum hoses 120 have an enlarged channel 124 running therethrough. As shown in FIG. 10, three vacuum hoses 120 are connected to each die unit 58 and connect to each of the two handle cutout hole fornming dies 66 and the single mouth cutout hole die 70. The interior diameter of the vacuum hoses 124 are substantially larger than the inner diameters $d_1$ and $d_2$ of dies 66 or 70. Manifold 122 is in turn connected to collection container 126 via an oversized vacuum conduit 128. Vacuum is placed on collection container 126 by a powerful vacuum 130 in vacuum communication with collection container 126. For convenience, a single collection container 126 and vacuum 130 can be utilized for a plurality of apparatuses, if desired.

The process by which mouth cutout hole 34 and flapless handle cutout 36 are formed is shown with reference to FIGS. 11–15. Referring to FIG. 11, hydraulic press plate 118 and the carried die unit 58 are originally positioned above a stack of bag pillowcases 116 on stationary support 114. Referring to FIGS. 12 and 13, hydraulic press plate 118 and die unit 58 are then brought into compressive contact with stack of bag pillowcases 116 on stationary support 114. The sharp cutting edge 90 of dies 66 and 70 will cut through stack of pillowcases 116, and will cut out plugs of holes 132. These plugs of holes 132 will enter passageway 96 in die 66 or 70 and remain there because of the decreasing inner diameter from the front to the rear thereof. Serrated compression bar 78 will compress localized areas of bag material, compressing them together and thereby form areas of frangible bonding 52 around central mouth cutout 34 in completed bag pack 60. (For sake of simplicity, serrated compression bars 80 and the areas of frangible bonding 54 they form in the bag pack are not shown. The sharp pins 86, and their formation of pin holes 57, and the cutting of the outline shape of the bag handles 16, mouth 18, and central tab 30 are also not shown, but simply cleanly cut through the pillowcase 116.) Of course, as noted above, if an unserrated compression bar is used, of if the angle of bevel 94 is shallow, the frangible bond formed will be more like that shown in FIG. 3. The resilient material layer 88 helps to ensure that stack of pillowcases 116 does not stick to the outer surface of the die unit 58, by pushing the now cut bag pack 10 or 60 away from die unit 58 after hydraulic pressure plate 118 is lifted away from now formed bag pack 10 or 60.

Referring now to FIG. 14, a second stack of uncut bag pillow cases **116*b* is next positioned on the stationary platform 114, readied for forming a second bag pack 60. In FIG. 15, mouth aperture cutout holes 70 are shown being formed in a second stack of pillowcases 116*b*, with the second plugs of holes 132 being forced up die's 66 or 70's central passageway 96. The vacuum on hoses 120 will suck plugs of holes 132 into manifold 122, through oversized vacuum conduit 128, and into collection container 126, where plug of holes 132 are collected are thereby are not free to float and scatter around and make the workplace messy and dangerous. These plugs of holes 132** can be recycled back into more plastic bags.

Referring to FIG. 16, a second embodiment of a hydraulic press 140 used to form bag packs 10 or 60 such as shown in FIGS. 1–4. In this embodiment, die unit 58 is placed on stationary platform 142, upon which an uncut stack of bag pillowcases 116 are placed, but upside down. Movable hydraulic pressure plate 144 will force the stack of bag pillowcases 116 downwardly onto die unit 58, cutting plugs of holes 146 and forming areas of frangible bonding as desired. Plugs of holes 146 will be forced downwardly into passageway 96 of die 70, and will fall (either by gravity alone, or assisted with vacuum) into plug receptacle 148.

The benefit of incorporating flapless cutouts for central mouth cutout 34 in the central tab portion 30 and for handle holes 36 in handles 16 is that unlike conventional handle apertures with flaps, or apertures that comprise slits, after a bag is removed from a bag pack 10 or 60 on a bagging rack 42, no portion of the removed bag remains on rack 42, and no flaps are formed in bag 10 or 60. Again, the result is a more neat appearance, and one in which there is not possibility of flaps becoming separated from the bag pack (because there are no flaps.)

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation, the scope of the invention being delineated in the following the claims which follow.

We claim:

1. An apparatus for forming a pack of self-opening plastic bags from a stack of presealed bag pillowcases, the pack of self-opening plastic bags having a central tab portion extending from a mouth region, a pair of handles, and an aperture cutout formed in at least the central tab portion, the apparatus comprising:

a die unit, comprising at least one central mouth tab aperture die portion for forming an aperture cutout in the central tab portion, the at least one central mouth tab aperture die portion having a continuous perimeter blade wall which defines an interior passageway therein, the continuous perimeter blade wall having a forwardly lying sharpened cutting edge for use in forming the aperture cutout in the central tab portion, having a sharp bag outline cuitting blade bent to define a shape to form the mouth region, handles, and central mouth tab in the pack of bags, and a compression means for forming frangibly bonded areas in the central tab portion of the pack of self-opening plastic bags;

means for moving the die unit;

a vacuum generating source;

a receptacle connected to the vacuum generating source;

vacuum lines connecting the interior passageways of the at least one die with the receptacle;

wherein application of the die unit by the means for moving the die unit to a stack of presealed bag pillowcases will cause plugs corresponding to material removed from the bag pack by the continuous perimeter blade wall to define the aperture cutouts to be cut from the bag pack, and will cause localized areas of frangible bonding to be formed through the stack of presealed bag pillowcases, wherein the plugs will be evacuated through the vacuum lines to the receptacle.

2. The apparatus of claim 1, wherein the means for moving the die unit comprises a hydraulic press.

3. The apparatus of claim 2, wherein a plurality of die units are provided on a single hydraulic press, and the vacuum lines are connected to a vacuum manifold, which vacuum manifold is connected to the receptacle by an enlarged vacuum line.

4. The apparatus of claim 1, wherein the die unit further comprises a backing plate, the sharp bag outline cutting blade being affixed to the backing plate, two generally cylindrical handle cutout die portions with frontward cutting edges defining an interior passageway and positioned in holes in the backing plate, and the central mouth tab aperture cutout being positioned in a hole in the backing plate, a tear initiating blade portion positioned adjacent the continuos perimeter blade wall, and wherein the compression means comprises a compression bar portion positioned on the backing plate and having a forward edge which extends forward from the backing plate to a lesser degree than does the cutting edge of the continuous perimeter blade.

5. The apparatus of claim 4, wherein the interior passageways of the two generally cylindrical handle cutout die portions and the generally cylindrical central mouth tab cutout die portion are narrower at their cutting edges and wider rearwardly thereof.

6. The apparatus of claim 4, wherein the compression bar portion is formed around at least a lower portion of the generally cylindrical central mouth tab cutout die portion.

7. The apparatus of claim 4, wherein the compression bar portion is serrated and is formed around the generally cylindrical central mouth tab cutout die portion except for a portion where the tear initiating blade portion intersects the generally cylindrical central mouth tab cutout die portion, and wherein additional compression bar portions are positioned in a spaced apart orientation from the portion of the sharp blade portion used for forming the central mouth tab portion.

8. The apparatus of claim 1, wherein the compression means for forming frangibly bonded areas in the central tab portion comprises the central mouth tab cutout die portion having a beveled cutting edge which is beveled at an angled between about 45 degrees and 30 degrees from the vertical.

9. The apparatus of claim 1, wherein the one central mouth tab aperture die portion is for use in forming a flapless aperture cutout in the central tab portion.

10. The apparatus of claim 1, wherein the one central mouth tab aperture die portion is for use in forming a flapless aperture cutout in the central tab portion.

11. An apparatus for forming a pack of tabless, self-opening plastic bags from a stack of presealed bag pillowcases, the pack of self opening plastic bags having a central tab portion extending from a mouth region, a pair of handles, and a aperture cutout formed in at least the central tab portion, the apparatus comprising:

a die unit, comprising at least one central mouth tab aperture die portion for forming an aperture cutout in the central tab portion, the at least one central mouth tab aperture die portion having a continuous perimeter blade wall with a sharp cutting edge which defines an interior passageway therein, the continuous perimeter blade wall having a forwardly lying sharpened cutting edge for use in forming the aperture cutout in the central tab portion, having a sharp bag outline cutting blade bent to define a shape to form the mouth region, handles, and central mouth tab in the pack of bags, and a compression means for forming frangibly bonded areas in the central tab portion of the pack of self-opening plastic bags;

means for moving the die unit;

a receptacle in communication with the interior passageway of the at least one central mouth tab aperture die portion;

wherein application of the die unit by the means for moving the die unit to a stack of sealed bag pillowcases will cause cutout plugs corresponding to material removed from the bag pack by the continuous perimeter blade wall to define the aperture cutouts to be cut from the bag pack, and will cause localized areas of frangible bonding to be formed through the stack of presealed bag pillowcases, wherein the cutout plugs will be pushed through the interior passageway of the at least one central mouth tab aperture die portion and into the receptacle.

12. The apparatus of claim 11, further comprising a vacuum generating source in communication with the receptacle and the passageway of the at least one die to assist in evacuating cutouts from the at least one die's interior passageway and into the receptacle.

13. A method for forming, from sealed bag pillowcases made of plastic material, a pack of tabless, self-opening plastic bags having a central tab portion extending ftom a mouth, a pair of handles, and an aperture cutout formed in the central tab portion and aperture cutouts in the handles, the method comprising the steps of:

stacking in alignment a plurality of flattened sealed plastic bag pillowcases sealed at top and bottom edges thereof;

providing a die unit comprising a backing plate, a sharp blade portion affixed to the backing plate and shaped for cutting an outline of the pair of handles, the mouth, and the central mouth tab portion in the bag pack, two handle cutout die portions having sharp cutting edges and being positioned in holes in the backing plate, and a generally cylindrical central mouth tab cutout die portion with a sharp cutting edge and defining an interior passageway and positioned in a hole in the backing plate shaped for forming the aperture cutout in the central tab portion, the generally cylindrical central mouth tab cutout die portion having a tear initiating blade portion positioned adjacent the continuous perimeter blade wall, and wherein the compression means comprises a bar portion positioned on the backing plate and having a forward edge which extends forward from the backing plate to a lesser degree than does the cutting edges of the sharp blade portion and the generally cylindrical central mouth tab cutout die portion;

providing means to move the die unit; and applying the die unit to the stack of sealed plastic bag pillowcases such that the sharp blade portion affixed to the backing plate and shaped for cutting the outline of the pair of handles, the mouth, and the central mouth tab portion in the bag pack cuts the outline of the bag packs handles, mouth and central mouth tab, such that the generally cylindrical central mouth tab cutout die portion and the tear initiating blade portion cuts the generally cylindrical central mouth tab cutout and a tearing slit to form the cylindrical central mouth tab plug cutouts comprising plastic bag material cut by the generally cylindrical central mouth tab cutout die portion which are forced into the interior passages of the cylindrical central mouth tab cutout die portion to remove the cylindrical central mouth tab cutout plug cutout fom the stack of presealed plastic bag pillowcases, and such that the bar portion compresses the plastic bag material together to form the areas of bonding between adjacent bags.

14. The method of claim 13, further comprising the step of providing a vacuum source, a receptacle connected to the vacuum source, a vacuum manifold connected to the receptacle, and a plurality of vacuum hoses connecting the interior passageways of the handle cutout die portions and the central mouth tab cutout die portion to the vacuum manifold.

* * * * *

UNITED STATES PATENT AND TRADEMARK OFFICE

CERTIFICATE OF CORRECTION

PATENT NO. : 5,967,962
DATED : October 19, 1999
INVENTOR(S) : Frank F.J. Huang; Daniel C. Huang It is certified that error appears in the above-identified patent and that said Letters Patent is hereby corrected as shown below:

Title page,
Item [56] References Cited, U.S. Patent Documents, replace "3,739,694 6/1973 David" with -- 3,739,694 6/1973 Davis --; and replace "3,802,308 4/1973 David" with -- 3,802,308 4/1974 Davis --.

Column 12,
Line 26, replace "cuitting" with -- cutting --.
Line 60, replace "continuos" with -- continuous --.

Column 13,
Line 19, replace "an angled" with -- an angle --.
Lines 24-26, delete claim 10 entirely (it is a duplicate of claim 9).
Line 31, replace "a aperture" with -- an aperture --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*